US005619020A

United States Patent [19]

Jones et al.

[11] Patent Number: 5,619,020

[45] Date of Patent: Apr. 8, 1997

[54] MUFFLER

[75] Inventors: Owen Jones; Michael C. J. Trinder, both of Colchester, Great Britain

[73] Assignee: Noise Cancellation Technologies, Inc., Linthicum, Md.

[21] Appl. No.: 599,642

[22] Filed: Feb. 9, 1996

Related U.S. Application Data

[63] Continuation of Ser. No. 199,238, filed as PCT/GB92/01594, Aug. 28, 1992, abandoned.

[30] Foreign Application Priority Data

Aug. 29, 1991 [GB] United Kingdom ..... 9118779
Aug. 28, 1992 [WO] WIPO ..... PCT/GB92/01594

[51] Int. Cl.[6] ..... F01N 1/06
[52] U.S. Cl. ..... 181/206; 381/71
[58] Field of Search ..... 181/206; 381/71; 60/312

[56] References Cited

U.S. PATENT DOCUMENTS 5,044,464 9/1991 Bremigan ..... 181/206
5,233,137 8/1993 Geddes ..... 181/206
5,272,286 12/1993 Cain et al. ..... 181/206

*Primary Examiner*—Khanh Dang
*Attorney, Agent, or Firm*—Crowell & Moring

[57] ABSTRACT

A muffler for muffling noise in a fluid flow, such as exhaust gases from an internal combustion engine comprises a chamber, loudspeakers for injecting anti-noise into the chamber under the control of processing circuitry in dependence upon residual noise detected by a microphone. The gas flows from an inflow pipe to an outflow pipe past a radial aperture that produces an acoustic coupling between the chamber and the gas flow, to allow the anti-noise to mix with noise in the gas flow and produce noise cancellation. The coupling is so arranged that the chamber becomes pressurized by the gas flow, in use, so as to restrict hot gas flow through the chamber and thereby provide an essentially benign environment for the loudspeaker.

18 Claims, 1 Drawing Sheet

MUFFLER

This is a continuation of application Ser. No. 08/199,238, filed as PCT/GB92/01594 on Aug. 28, 1992, abandoned.

FIELD OF THE INVENTION

The present invention relates to a muffler for muffling noise in a fluid flow, for example the exhaust flow from of an internal combustion engine.

BACKGROUND OF THE INVENTION

Most noise from an internal combustion engine propagates from the engine's exhaust ports and has commonly been suppressed by means of mufflers, also known as silencers, located in an exhaust pipe connected to the ports. Such mufflers are entirely passive devices.

It has been proposed to use active noise control techniques to control the noise propagating along the exhaust pipe. In one such system, the exhaust pipe is caused to pass through a chamber, in which a loudspeaker is mounted. The loudspeaker is used to produce anti-noise in the chamber, for cancelling the exhaust noise. It has been found that in order for there to be sufficient acoustic coupling between the loudspeaker and the inside of the exhaust pipe, the portion of the exhaust pipe passing through the chamber should be perforated. However, a problem with this arrangement is that exhaust gases pass out through the perforations located towards the chamber inlet. This escape of exhaust gases results in a pressure differential along the length of the perforated portion of the pipe. As the pressure in the perforated portion of the pipe is lower towards the chamber outlet than towards the chamber inlet, exhaust gases in the chamber are drawn back into the exhaust pipe through the perforations located towards the chamber outlet. Thus, there is a constant flow of hot exhaust gases through the chamber during operation. These hot exhaust gases are deleterious to the loudspeaker mounted in the chamber.

In an alternative arrangement, an inflow pipe passes completely through the chamber and terminates within an outflow pipe. However, it has ken found that when such an arrangement is used in a virtual earth noise cancellation system, the positioning of the system microphone is extremely critical. Even with the microphone optimally placed, it is still not possible to achieve effective cancellation over a wide range of frequencies.

It is an object of the present invention to overcome the aforementioned disadvantages of the prior art and provide a muffler which enables satisfactory acoustic coupling to the interior of an exhaust pipe while providing a benign environment for a loudspeaker.

SUMMARY OF THE INVENTION

According to the present invention there is provided a muffler for muffling noise in a fluid flow, comprising a chamber, means for injecting anti-noise into the chamber, a conduit for conveying a fluid stream, means for receiving fluid flowing from the conduit, and coupling means including a radial aperture between the conduit and the receiving means, for acoustically coupling the chamber to the fluid stream, wherein the coupling means is arranged such that the chamber becomes pressurised in use, such as to restrict flow of fluid from the fluid stream through the chamber.

Preferably, the muffler is arranged to act as an acoustical filter.

Conveniently, the conduit passes through the chamber, terminating just short of an opening in a wall of the chamber, in which case the conduit termination and the aperture can be coaxially aligned and the acoustic coupling means comprises the gap between the conduit termination and the opening. Alternatively, the conduit may run along the side of a chamber, the acoustic coupling means comprising a slot coupling the interior of the chamber with the gas flow in the conduit. The coupling means may also include bridging members for physically coupling the conduit to the receiving means.

Advantageously, the internal diameter of the conduit is less than the internal diameter of the receiving means. However, under certain circumstances, this may not be necessary to achieve satisfactory performance by the muffler.

Preferably, the muffler will include a microphone.

Conveniently, the means for injecting anti-noise into the chamber comprises a loudspeaker. A plurality of loudspeakers may be employed.

Advantageously, the passive frequency response of the muffler may be tailored by resistively or capacitively loading the loudspeaker. Also, the drive circuit for the loudspeaker may include an amplifier circuit with a gain/frequency response configured to drive the loudspeaker so that its frequency response is modified to have a desired characteristic over a given frequency range.

The muffler may be employed in an active noise cancellation system, for example in the exhaust system of an internal combustion engine.

BRIEF DESCRIPTION OF THE DRAWINGS

Embodiments of the present invention will now be described, by way of example, with reference to the accompanying drawings, in which.

DESCRIPTION OF EMBODIMENTS

Figure 1:
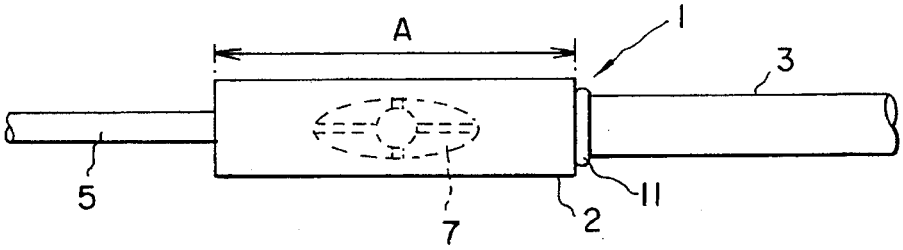
FIG. 1 is a side view of a muffler according to the present invention.
Figure 2:
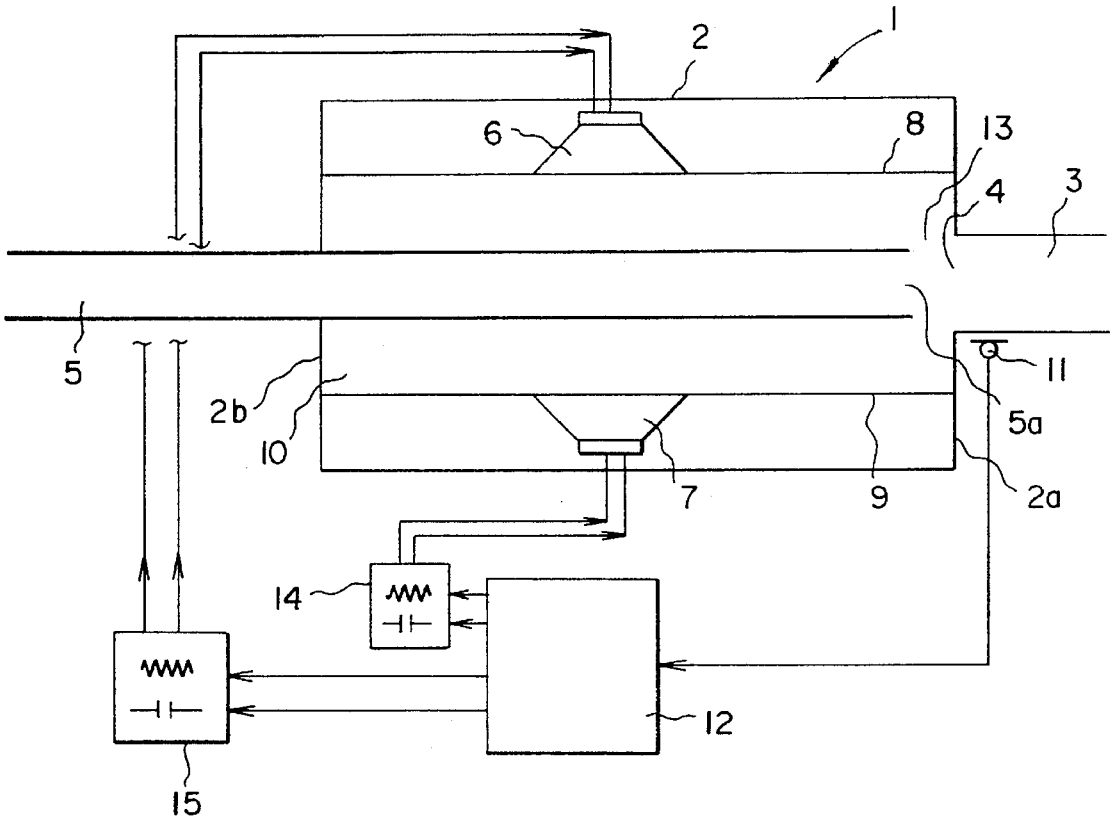
FIG. 2 is a diagramatic representation of a muffler according to the present invention, employed in an active noise cancellation system.

Referring to FIGS. 1 and 2, a muffler 1 comprises a rectangular box 2 formed from sheet metal. An outflow pipe 3 extends outwardly from a circular opening 4 located in a wall 2*a* of the box 2. An inflow pipe 5 extends through a wall 2*b* of the box 2, opposite the opening 4, to a point just short of and in axial alignment with the opening 4. In a box 2 having a dimension A of 400 mm, the inflow pipe 5 terminates 25 mm short of the aperture 4. The space between the end of the inflow pipe and the opening 4 defines a radial aperture 13 which in use produces an acoustical coupling between a chamber 10 and gas flowing from the inflow pipe 5 to the outflow pipe 3, as will be explained in more detail hereinafter.

A pair of partitions 8 and 9 run parallel to the inflow pipe 5 and divide the box into three chambers. A central chamber 10 is defined between the partitions 8 and 9. Two moving coil loudspeakers 6 and 7 are mounted in the partitions 8 and 9 respectively, such that they are directed towards the inflow pipe 5.

A microphone 11 is mounted on the outflow pipe 3, adjacent to where it joins the box 2. An electronic processing unit 12, such as disclosed in our copending UK Patent Application No. 9116433.5 has an input which is electrically coupled to the microphone 11 and outputs which are coupled to respective speakers 6 and 7.

In operation, a portion of a gas stream flowing along the inflow pipe 5 will initially enter the central chamber 10. However, the central chamber 10 will quickly become pressurised thus restricting the further ingress of exhaust gases. Consequently, an exhaust gas flow path does not become established through the chamber. Hence, the environment in the central chamber 10 remains essentially benign for the speakers 6 and 7 as they are not exposed directly to a hot gas flow.

Accompanying the gas stream are sound waves, comprising engine noise, which propagate along the inflow pipe 5 into the chamber 1 and out through the opening 4. The geometry of the muffler is designed so that higher frequencies, in the order of a few hundred hertz, are attenuated in the muffler.

Sound emerging from the muffler and propagating along the outflow pipe 3 is sensed by the microphone 11 which sends an electrical signal representative of this sound to the input of the processing unit 12. The processing unit 12 outputs electrical cancelling signals which drive the speakers 6 and 7 to produce anti-noise. The anti-noise mixes with the engine noise in the central chamber 10, which results in the sound propagating along the outflow pipe 3 having a much smaller amplitude than that propagating along the inflow pipe 5. Once the control loop including processing unit 12 has come into operation, the microphone 11 senses the result of the mixing of the engine noise and the anti-noise produced by the speakers 6 and 7.

With the arrangement described above, it has been found that a certain degree of enhancement can occur at noise frequencies in the 10 to 50 hertz region. The passive performance of the muffler in this region can be modified by reducing the electrical damping of the loudspeaker. This may be achieved by either connecting a low value resistor, for example 5 ohms, or a capacitance, for example 1000 microfarrads, in parallel with each loudspeaker 6 and 7. The exact values for these additional components will depend on the geometry of the muffler employed and the degree of modification of the muffler response which is required.

The loudspeaker may be driven by circuits (within element 12) including amplifiers with frequency/gain characteristics selected to modify the natural characteristics of the loudspeakers. For example, the loudspeakers 6 and 7 may be made to appear acoustically as simple masses over a given frequency range. This is achieved by arranging for the circuits driving the loudspeakers 6 and 7, to have output impedances which are the complex conjugates of the loudspeaker impedances over the given frequency range.

Whilst in the embodiment described hereinbefore, moving coil loudspeakers have been employed, other forms of transducer may usefully be employed such as piezo electric devices.

Although the inflow pipe 5 has been shown entering the chamber 1 through a wall opposite the aperture 4, alternative arrangements may be employed so long as the inflow pipe 5 terminates in alignment adjacent to the opening 4 so as to define a radial aperture such as the aperture 13.

Since, mixing of the engine noise and the anti-noise occurs within the central chamber 10 the position of the microphone 11 is not critical. Consequently, the microphone 11 may be placed in any convenient position e.g. within the central chamber 10 or at the discharge end of the outflow pipe 3.

The passive attenuation of higher frequency noise means that the processing unit 12 may be of a simple design since it need only function over a restricted frequency range.

In a modification, the muffler includes a compliant membrane (not shown) to isolate the region of the chamber 10 containing the loudspeakers 6 and 7 from the pipe 5, the membrane being substantially acoustically transparent for transmission of the anti-noise, but mechanically isolating gas from the exhaust from reaching the loudspeakers. As another modification, the inflow pipe 5 may be connected to the outflow pipe 3 on its lower side, thereby extending across the lower side of the aperture 13 in order to provide a flow path for liquid condensate in the pipe 5 to the outflow pipe 3. In this way an accumulation of liquid condensates in the chamber 10 is avoided.

It may also be desirable to include at least one interport in the baffles 8 and 9 to modify the acoustic characteristics of the chamber 10. In the aforegoing description the term anti-noise is used to mean acoustic signals controlled in phase and amplitude so as to tend to cancel an unwanted noise.

We claim:

1. A muffler for attenuating noise in a gaseous flow, said muffler comprising:

a chamber means having a first end, and a second end with a receiving means, said first end having a first opening and said receiving means having a second opening;

a conduit means for conveying gaseous stream into said chamber, said conduit means having a front end and a rear end and surrounded by said chamber, said conduit means terminating short of said second opening, thereby defining a radial aperture; and actuator means with a plurality of terminals, said actuator means positioned within said chamber for injecting anti-noise waves into said chamber so as to attenuate noise accompanying said gaseous flow, said actuator means being directed towards said conduit means, and wherein said terminals of said actuator means are terminated in a suitable electrical impedance;

an acoustic coupling means including said radial aperture between said rear end of said conduit means and said chamber for acoustically coupling said chamber to the gaseous stream, and wherein the coupling means is configured so that the chamber becomes pressurized while in use so as to restrict flow of gas from said gasesous stream through said chamber.

2. A muffler according to claim 1, wherein the muffler acts as an acoustical filter.

3. A muffler according to claim 1, wherein the conduit extends through the chamber.

4. A muffler according to claim 1, wherein the acoustic coupling means is within the chamber.

5. A muffler according to claim 1, wherein the acoustic coupling means comprises a gap between said rear end of said conduit means and said receiving means.

6. A muffler according to claim 1, wherein said conduit means is circular and has an internal diameter and said receiving means includes a circular opening, the internal diameter of said conduit means is less than that of said opening of the receiving means.

7. A muffler according to claim 1 including a microphone means positioned adjacent said receiving means for detecting residual noise to produce an electrical error signal.

8. A muffler according to claim 1, wherein the actuator means for injecting anti-noise comprises a loudspeaker.

9. A muffler according to claim 8 wherein the actuator means for injecting anti-noise comprises a plurality of loudspeakers.

10. A muffler according to claim 8, wherein said loudspeaker terminals are resistively loaded with a resistor.

11. A muffler according to claim 8, wherein said loudspeaker terminals are capacitively loaded by a capacitor.

12. A muffler according to claim 1, wherein the conduit means is an exhaust pipe connected to an internal combustion engine.

13. A muffler according to claim 2, wherein the conduit means extends through the chamber.

14. A muffler according to claim 2, wherein the acoustic coupling means is within the chamber.

15. A muffler according to claim 3, wherein the acoustic coupling means is within the chamber.

16. A muffler according to claim 9, wherein said loudspeaker terminals are resistively loaded by a resistor.

17. A muffler according to claim 9, wherein said loudspeaker terminals are capacitively loaded by a capacitor.

18. A muffler according to claim 8, wherein said loudspeaker terminals are loaded by an amplifier to modify the characteristics of said loudspeaker.

* * * * *